US006988648B2

(12) United States Patent
Taylor et al.

(10) Patent No.: US 6,988,648 B2
(45) Date of Patent: Jan. 24, 2006

(54) ADJUSTABLE DEPTH OF DRIVE DEVICE

(75) Inventors: Walter J. Taylor, McHenry, IL (US); Yury Shkolnikov, Glenview, IL (US); Jeffrey G. Eckardt, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/796,923

(22) Filed: Mar. 1, 2001

(65) Prior Publication Data

US 2002/0121540 A1 Sep. 5, 2002

(51) Int. Cl.
*B25C 1/04* (2006.01)

(52) U.S. Cl. ..... 227/142

(58) Field of Classification Search ..... 227/142, 227/8, 130

See application file for complete search history.

(56) References Cited

U.S. PATENT DOCUMENTS

| | | | | |
|---|---|---|---|---|
| 4,327,485 | A * | 5/1982 | Rix | 29/751 |
| 4,405,071 | A * | 9/1983 | Austin | 227/7 |
| 4,483,474 | A | 11/1984 | Nikolich | |
| 4,767,043 | A | 8/1988 | Canlas, Jr. | |
| 5,083,694 | A | 1/1992 | Lemos | |
| 5,207,143 | A | 5/1993 | Monacelli | |
| 5,219,110 | A | 6/1993 | Mukoyama | |
| 5,261,587 | A | 11/1993 | Robinson | |
| 5,263,842 | A | 11/1993 | Fealey | |
| 5,385,286 | A | 1/1995 | Johnson, Jr. | |
| 5,447,265 | A * | 9/1995 | Vidal et al. | 227/176.1 |
| 5,484,094 | A | 1/1996 | Gupta | |
| 5,564,614 | A | 10/1996 | Yang | |
| 5,579,977 | A | 12/1996 | Yang | |
| 5,667,127 | A | 9/1997 | Ichikawa et al. | |
| 5,685,473 | A | 11/1997 | Shkolnikov et al. | |
| 5,785,227 | A | 7/1998 | Akiba | |
| 5,816,468 | A | 10/1998 | Yang | |
| 5,839,638 | A | 11/1998 | Ronn | |
| 6,012,622 | A | 1/2000 | Weinger et al. | |
| 6,024,267 | A | 2/2000 | Chen | |
| 6,170,729 | B1 | 1/2001 | Lin | |
| 6,179,192 | B1 * | 1/2001 | Weinger et al. | 227/8 |
| 6,186,386 | B1 | 2/2001 | Canlas et al. | |

FOREIGN PATENT DOCUMENTS

| | | |
|---|---|---|
| EP | 0 298 594 | 1/1989 |

* cited by examiner

*Primary Examiner*—Scott A. Smith
(74) *Attorney, Agent, or Firm*—Lisa M. Soltis; Mark W. Croll; Laura R. Wanek

(57) ABSTRACT

An adjustable depth of drive device for use on a fastener driving tool. The adjustable depth of drive device includes a thumb post which is mounted to, and extends from a work piece contact element of the tool. Also included is a thumb wheel which is removably attached to the thumb post. A spring member is another part of the adjustable depth of drive device, and it is engagable with the thumb wheel in at least two positions. In a first position, the spring member is frictionally engaged with the thumb wheel to prevent unwanted movement of the thumb wheel relative to the thumb post, and this first position allows for fine adjustments of the position of the work piece contact element. In a second position, the spring member is disengaged from the thumb wheel to permit free rotation of the thumb wheel on the thumb post, which allows for gross adjustments of the position of the work piece contact element.

15 Claims, 3 Drawing Sheets

ADJUSTABLE DEPTH OF DRIVE DEVICE

The present invention relates generally to fastener driving tools such as combustion powered tools, pneumatic tools, cordless framing tools and the like. More particularly, the present invention relates to improvements in a device which adjusts the depth of drive of the tool.

BACKGROUND OF THE INVENTION

As exemplified in Nikolich, U.S. Pat. Re. No. 32,452, and U.S. Pat. Nos. 4,552,162; 4,483,473; 4,483,474; 4,404,722; 5,197,646; 5,263,439; 5,558,264 and 5,678,899 all of which are incorporated by reference, fastening tools, and particularly, portable combustion powered tools for use in driving fasteners into workpieces are described. Such fastener-driving tools are available commercially from ITW-Paslode (a division of Illinois Tool Works, Inc.) of Vernon Hills, Ill., under the IMPULSE® brand.

Such tools incorporate a generally gun-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

The wall of a combustion chamber is axially reciprocable about a valve sleeve and, through a linkage, moves to close the combustion chamber when a workpiece contact element at the end of a nosepiece connected to the linkage is pressed against a workpiece. This pressing action also triggers a fuel metering valve to introduce a specified volume of fuel gas into the closed combustion chamber from the fuel cell. The metering valve may take the form of a solenoid valve, which is powered by the battery, or may be a purely mechanical valve.

Upon the pulling of a trigger, which causes the ignition of a charge of gas in the combustion chamber of the engine, the piston and driver blade are shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original, or "ready" position through differential gas pressures within the cylinder. Fasteners are fed into the nosepiece from a supply assembly, such as a magazine, where they are held in a properly positioned orientation for receiving the impact of the driver blade. The power of the tools differs according to the length of the piston stroke, volume of the combustion chamber, fuel dosage and similar factors.

Combustion powered tools have been successfully applied to large workpieces requiring large fasteners, for framing, roofing and other heavy duty applications. Smaller workpiece and smaller fastener trim applications demand a different set of operational characteristics than the heavy-duty, "rough-in", and other similar applications. Other types of fastener driving tools such as pneumatic, powder activated and/or electrically powered tools are well known in the art, and are also contemplated for use with the present adjustment mechanism.

One operational characteristic required in trim applications is the ability to predictably control fastener driving depth. For the sake of appearance, some trim applications require fasteners to be countersunk below the surface of the workpiece, others require the fasteners to be sunk flush with the surface of the workpiece, and some may require the fastener to stand off above the surface of the workpiece. Depth adjustment has been achieved in pneumatically powered and combustion powered tools through a tool controlling mechanism, referred to as a drive probe, that is movable in relation to the nosepiece of the tool. Its range of movement defines a range for fastener depth-of-drive. Similar depth of drive adjustment mechanisms are known for use in combustion type framing tools.

Existing depth adjusting mechanisms do have some drawbacks. One disadvantage of previous depth adjusting mechanisms is that they will only allow one speed of adjusting, usually gross adjustment. Many projects require the user to accurately set the depth of drive at a specific measurement. This can be difficult to accomplish when the adjusting mechanism only allows for gross adjustments, and therefore the user may have to adjust the depth of drive several times through trial and error in order to obtain the correct measurement for the depth of drive.

Consequently, one object of the present invention is to provide an improved depth of drive adjustment drive for use in a fastener driving tool, which allows the user to adjust the depth adjusting mechanism in either a fine or gross adjustment setting.

Another object of the present invention is to provide an improved depth of drive device for a fastener driving tool which allows for convenient and easy switching between fine and gross adjustments without releasing latches or other mechanisms.

Still another object of the present invention is to provide an improved depth of drive adjustment device for a fastener driving tool which is relatively inexpensive to manufacture and simple to assemble.

SUMMARY OF THE INVENTION

The above-listed objects are met or excluded by the present adjustable depth of drive device for use on a fastener driving tool, such as a combustion type framing tool or the like. An important feature of the present device is a spring loaded thumb wheel or barrel which is constructed and arranged to adjust the position of the workpiece contact element relative to the nosepiece so that either gross or fine adjustments may be made in virtually the same user motion, without the use of complicated latch mechanisms.

More specifically, the present invention provides an adjustable depth of drive device for use on a fastener driving tool having a housing structure which defines an axis, and encloses a combustion chamber, and a nosepiece which extends generally axially from the housing with a workpiece contact element. The device includes a thumb post which is mounted to, and extends from the workpiece contact element. A thumb wheel is adjustably engaged on the thumb post, and a spring member is engagable with the thumb wheel in at least two positions. In a first position, the spring member is frictionally engaged with the thumb wheel to prevent unwanted movement of the thumb wheel relative to the thumb post. In a second position, the spring member is disengaged from the thumb wheel to permit free rotation of the thumb wheel on the thumb post.

The spring member exerts a biasing force against the thumb wheel, and in the first position, the thumb wheel is manually movable when the biasing force is overcome, allowing for fine adjustments of the position of the work piece contact element relative to the nosepiece. Also, in the preferred embodiment, the spring member has a thumb lever for moving the spring member into the second position, allowing for gross adjustments of the position of the work-piece contacting element relative to the nosepiece.

DESCRIPTION OF THE PREFERRED EMBODIMENT

Figure 1:
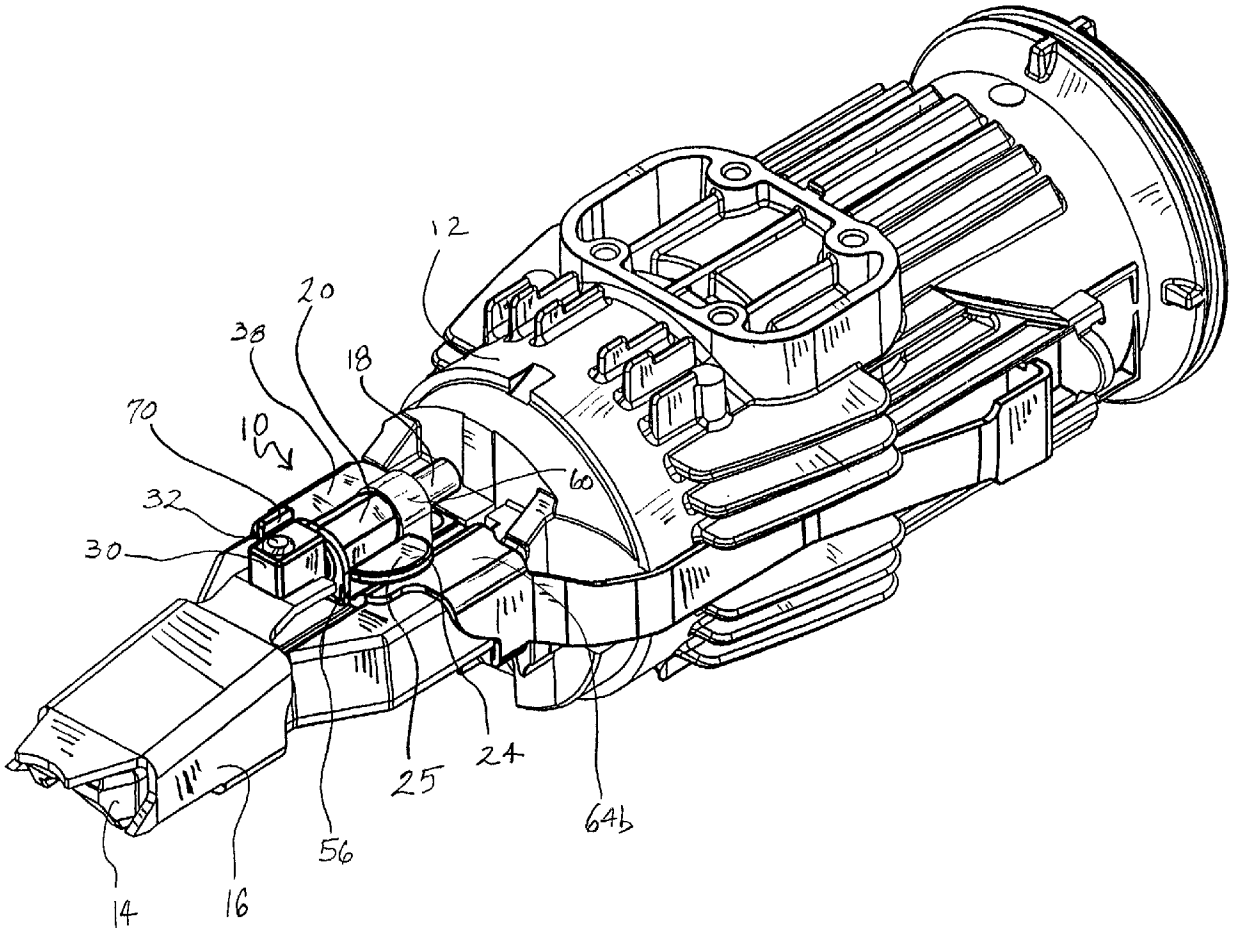
FIG. 1 is a perspective view of the present adjustable depth of drive device shown assembled and attached to the sleeve of a fastener driving tool.

As seen in FIG. 1, an improved adjustable depth of drive device is generally designated 10, and is intended for use on a fastener driving tool of the type described above. The tool includes a housing or sleeve structure 12 which defines an axis and encloses a combustion chamber (not shown), and a nosepiece 14 which extends axially from the housing structure, along with a work piece contact element 16.

Figure 2:
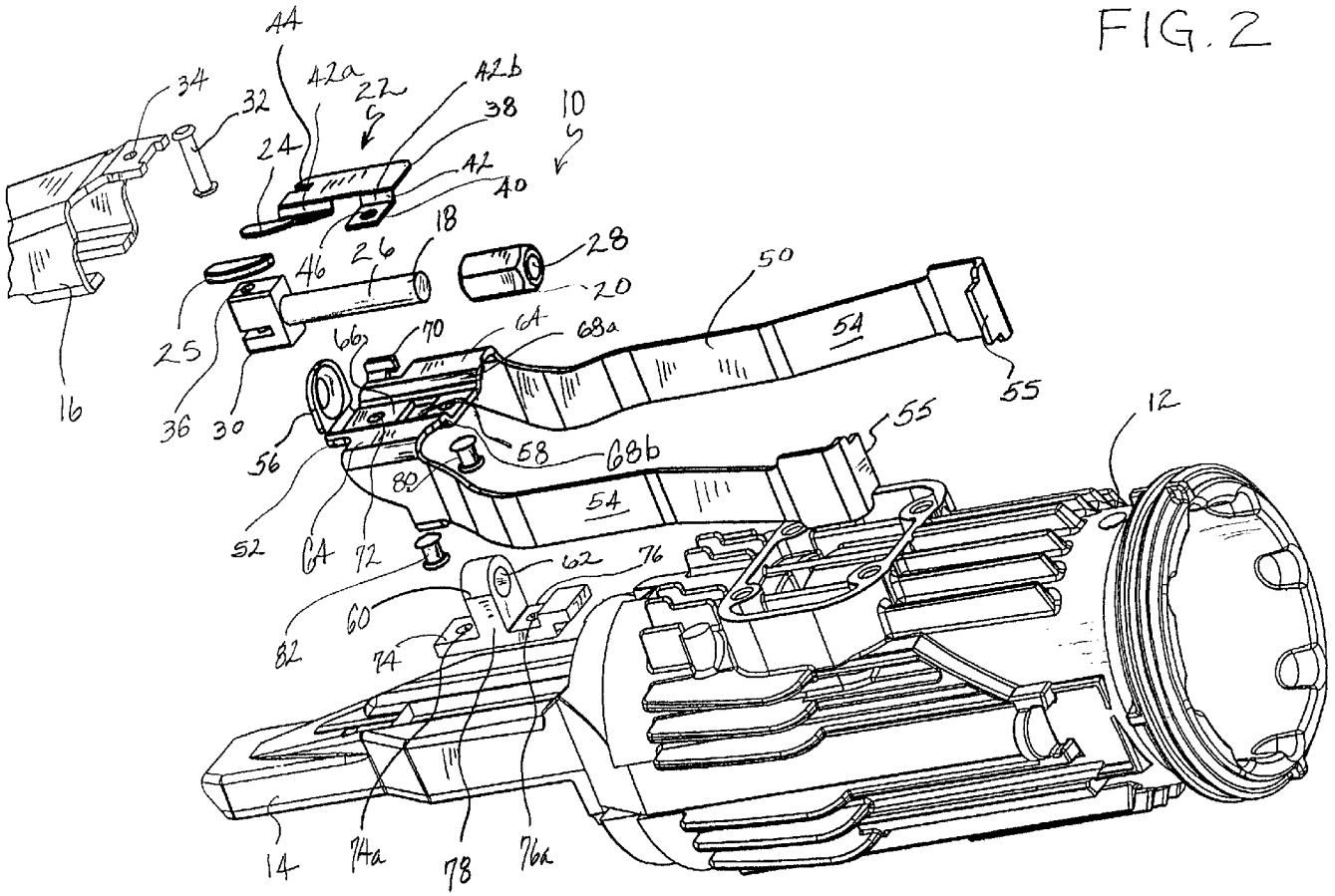
FIG. 2 is an exploded, perspective view showing the structure of the present adjustable depth of drive device and related structures.

Referring now to FIG. 2, the adjustable depth of drive device 10 includes a thumb post 18 which is mounted to, and extends from the work piece contact element 16. There is also a thumb wheel 20 which is removably attached to, and adjustably engaged on the thumb post 18, and a spring member, generally designated 22, that is engagable with the thumb wheel in at least two positions. In a first position, seen in FIG. 1, the spring member 22 is frictionally engaged with the thumb wheel 20 to prevent unwanted movement of the thumb wheel relative to the thumb post 18. In a second position (not shown), the spring member 22 is disengaged from the thumb wheel 20 to permit free rotation of the thumb wheel on the thumb post 18.

In the first position, the spring member 22 exerts a biasing force against the thumb wheel 20, and the thumb wheel is manually movable when the biasing force is overcome, allowing for fine adjustments of the position of the work piece contact element 16 relative to the nosepiece 14. It is an advantage of the present invention to allow a user to make fine adjustments to more accurately set the depth of drive without having to manually disengage the spring member 22, or any other extra latch member.

In both FIGS. 1 and 2, it can be seen that the spring member 22 has a thumb lever 24 for moving the spring member into the second position, allowing for gross adjustments of the position of the work piece contacting element 16 relative to the nosepiece 14. Preferably, a resilient, rubber-like thumb pad 25 is attached to the thumb lever 24, that provides a user with a cushion to make depressing the thumb lever more comfortable. The present device 10 allows a user to easily switch between fine adjustments and gross adjustments of the depth of drive by simply turning the thumb wheel 20 initially when the spring member 22 is in the first position for fine adjustments, or when the user depresses the thumb lever 24, placing the spring member in the second position for gross adjustments.

In the preferred embodiment as seen in FIG. 2, the thumb post 18 has a threaded exterior 26 and the thumb wheel 20 has a threaded interior bore 28, so that when the thumb wheel is rotated relative to the thumb post in either direction, the position of the thumb post is moved relative to the nosepiece 14. It is also preferred that the thumb post 18 extends from a clevis 30 that is connected to the work piece contact element 16 by a fastener 32, preferably a rivet, that extends through a work piece contact element hole 34 and a clevis bore 36. Upon assembly, the hole 34 and the bore 36 are placed in registry with each other. It is well known in the art that the rivet 32 may be replaced by another securing means such as a screw or other suitable type of fastener. In an alternative embodiment, the work piece contact element 16 and the thumb post 18 could be manufactured as one piece.

The spring member 22 itself includes a plate 38 and a securing tab 40 that are disposed in a parallel, displaced relationship with respect to one another. Also included is at least one shoulder flange 42, which connects the plate 38 to both the thumb lever 24 and the securing tab 40. As seen in FIG. 2, preferably there is a first shoulder flange 42*a* and a second shoulder flange 42*b* that connect the plate 38 respectively to the thumb lever 24 and the securing tab 40. However, in an alternative embodiment, it is possible for only one flange 42 to connect both the thumb lever 24 and the securing tab 40 to the plate 38. There is also a locating slot 44 that is defined by the edge of the plate 38, and a securing hole 46 is defined in the middle of the securing tab 40. Preferably the spring member 22 is made of steel, however any metal with similar qualities may be used, and even a hard, durable plastic or engineered material may be used for the spring member.

Still referring to FIG. 2, the adjustable depth of drive device 10 is connectable with a wire form 50 that has a platform 52 and a plurality of arms 54 extending from the platform, generally axially relative to the housing structure 12. Upper ends 55 of each of the preferably two arms 54 are received in the housing structure 12. An eyelet guide 56 is attached to the platform 52 and extends perpendicular thereto. There is also a platform hole 58 defined by the platform 52. A stop block 60 which has a guide opening 62, has a portion which is insertable through the platform hole 58 so that the eyelet guide 56 is in axial alignment with the guide opening. When the guide opening 62 and eyelet guide 56 are in alignment, the thumb post 18 is insertable through both the eyelet guide and the guide opening, and the thumb wheel 20 is positioned in between the eyelet guide and the stop block 60, and is engagable with the thumb post. In this position, the thumb wheel 20 secures and, by rotation, adjusts the relative position of the thumb post 18 relative to the housing 12.

Again referring to FIG. 2, the platform 52 has at least one upper plate 64 and a lower plate 66, and the platform has at least one curved shoulder 68 that connects the upper plate to the lower plate in a parallel displaced relationship. In the preferred embodiment, there is a first upper plate 64*a* and a second upper plate 64*b* that are on opposite sides of the lower plate 66, with a first curved shoulder 68*a* and a second curved shoulder 68*b* that connect the first upper plate and the second upper plate to the lower plate in a parallel displaced relationship. There is a locating lug 70 which is attached to the first upper plate 64*a* and is disposed to engage the locating slot 44 of the spring member 22. The lower plate 66 defines at least one and preferably two platform securing holes 72, used by a fastener to attach the wire form 50 to the spring member 22 and the stop block 60.

Also in the preferred embodiment, as seen in FIG. 2, the stop block 60 has a first mounting ear 74 connected to an end 78 of the stop block. Each mounting ear 74 and 76 has a mounting ear opening, respectively 74*a* and 76*a*. When fully assembled, the stop block 60 is inserted through the platform hole 58, and the mounting ears 74 and 76 abut the lower plate 66 so that the first mounting ear opening 74*a* and the second mounting ear opening 76*a* are in alignment with the corresponding securing holes 72. When the spring member 22 is included in the assembly, the securing hole 46 of the securing tab 40 is aligned with the corresponding platform securing hole 72, so that the flange 42 abuts against the first curved shoulder 68*a* and the locating lug 70 is positioned in the locating slot 44. In a preferred embodiment, a single rivet 80 is insertable through the securing hole 46, the platform securing hole 72, and the second mounting ear opening 76*a*, as a way to mount the entire structure together. A second rivet 82 is insertable through one of the platform securing holes 72 and the first mounting ear opening 74*a*.

Figure 3:
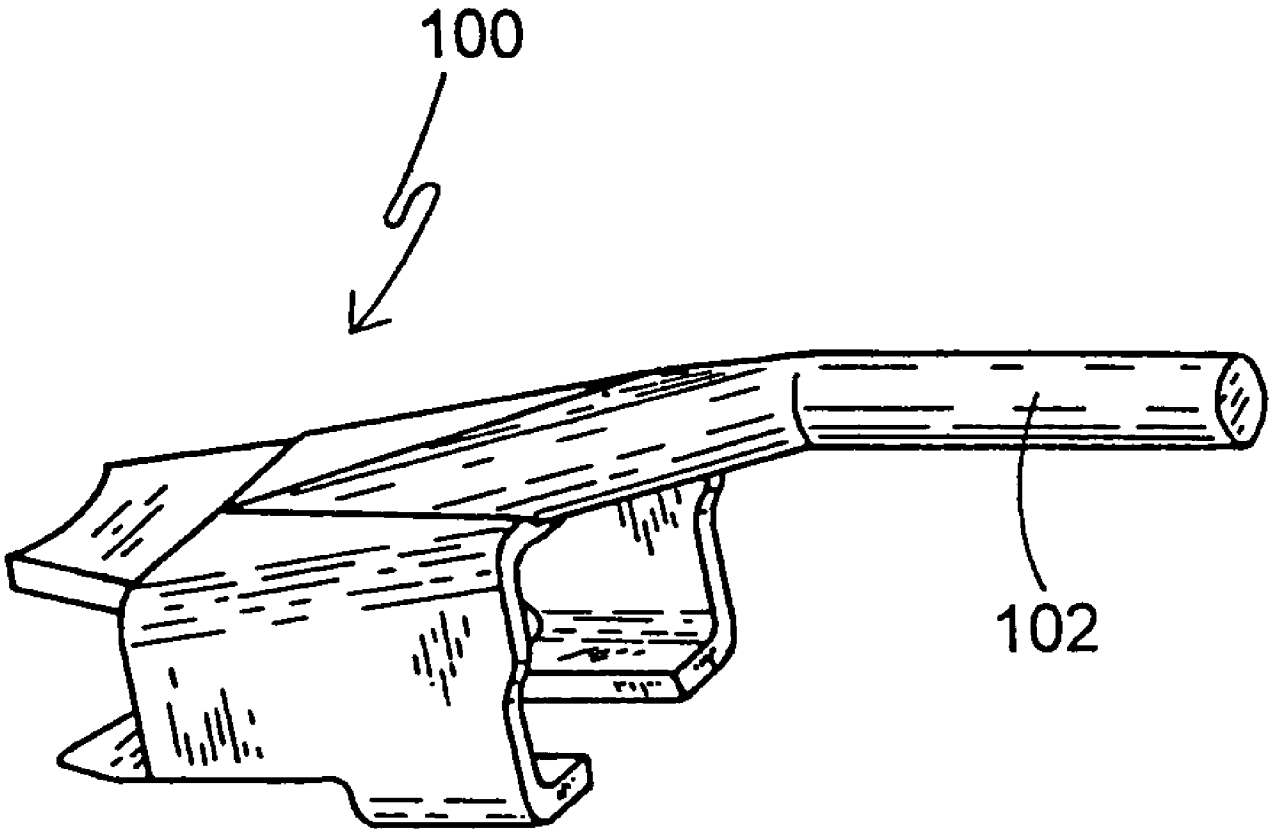
FIG. 3 is a perspective view of an alternate embodiment of work piece contact element of FIGS. 1 and 2.

Referring now to FIG. 3, an alternate embodiment of the workpiece contact element 16 is generally designated 100. Components of the element 100 which correspond to the element 16 are designated with identical reference numbers. The main difference between the elements 16 and 100 is that the latter is formed in a single piece casting combining elements the thumb post 18, the clevis 30 and the fastener 32. In the element 100, a thumb post 102 is an integral component of the casting. The element 100 otherwise operates in the same manner as the element 16.

When the adjustable depth of drive device 10 is completely assembled and attached to the housing structure 12 as shown in FIG. 1, a user may adjust the depth of drive by axially rotating the thumb wheel 20 in either direction. By turning the thumb wheel 20 in a clockwise rotation, the work piece contact element 16 will be moved toward the housing structure 12, which will decrease the depth of drive. Turning the thumb wheel 20 in a counter-clockwise direction will move the work piece contact element 16 away from the housing structure 12, which will increase the depth of drive.

The present device allows the user to adjust the depth of drive with fine or slow adjustments by turning the thumb wheel 20 in either direction while the spring member 22 is exerting a biasing force against the thumb wheel. The user can adjust the depth of drive with gross, or faster adjustments by depressing the thumb lever 24, so that it is no longer in contact with the thumb wheel 20 which allows the thumb wheel to rotate freely. The user is allowed to adjust the depth of drive with the present invention when the fastening tool is in an actuated or non-actuated position.

While a particular embodiment of the adjustable depth of drive device of the invention has been shown and described, it will be appreciated by those skilled in the art that changes and modifications may be made thereto without departing from the invention in its broader aspects and as set forth in the following claims.

What is claimed is:

1. An adjustable depth of drive device for use on a fastener driving tool having a housing structure which defines an axis and encloses a combustion chamber, and a nosepiece which extends axially from the housing structure along with a work piece contact element, comprising:

a thumb post which is mounted to, and extends from the work piece contact element;

a thumb wheel adjustably engaged on said thumb post; and a spring member in operational relationship with said thumb wheel in at least two positions, in a first position, said spring member is directly accessible and in frictionally biased engagement against said thumb wheel, said spring member in said frictionally biased engagement being configured for preventing unwanted movement of said thumb wheel yet being configured for permitting manual, bias-overcoming, rotatable fine adjustment of said thumb wheel relative to said thumb post, and in a second position, said spring member being directly accessible and disengagable from said thumb wheel to permit free rotation of said thumb wheel on said thumb post.

2. The adjustable depth of drive device of claim 1, wherein said thumb post has a threaded exterior and said thumb wheel has a threaded interior bore so that when said thumb wheel is rotated relative to said thumb post in either direction, the position of said thumb post is moved relative to the nosepiece.

3. The adjustable depth of drive device of claim 1, wherein said thumb post extends from a clevis, and said clevis is connected to the work piece contact element.

4. The adjustable depth of drive device of claim 1, wherein said spring member has a thumb lever for moving said spring member into said second position, allowing for gross adjustments of the position of the work piece contacting element relative to the nosepiece.

5. The adjustable depth of drive device of claim 4, further comprising a thumb pad that is attached to said thumb lever.

6. The adjustable depth of drive device of claim 4, wherein said spring member has a plate and a securing tab in a parallel displaced relationship with one another, and said plate defines a locating slot.

7. The adjustable depth of drive device of claim 6, wherein said spring member has at least one flange, and said at least one flange connects said plate to said thumb lever and said securing tab.

8. An adjustable depth of drive device for use on a fastener driving tool having a housing structure which defines an axis and encloses a combustion chamber, and a nosepiece which extends axially from the housing structure along with a work piece contact element, comprising:

a thumb post which is mounted to, and extends from the work piece contact element;

a thumb wheel adjustably engaged on said thumb post;

a spring member in operational relationship with said thumb wheel in at least two positions, in a first position, said spring member is frictionally biased against said thumb wheel to prevent unwanted movement, yet permitting manual bias-overcoming, rotatable fine adjustment of said thumb wheel relative to said thumb post and relative to said spring member and in a second position, said spring member is disengaged from said thumb wheel to permit free rotation and gross adjustment of said thumb wheel on said thumb post;

a wire form having a platform and a plurality of arms extending from said platform, generally axially relative to the combustion chamber;

an eyelet guide attached to extend perpendicular to said platform;

a platform hole defined by said platform; and a stop block having a guide opening, and being inserted through said platform hole so that said eyelet guide is in axial alignment with said guide opening;

wherein said thumb post is insertable through both said eyelet guide and said guide opening, and said thumb wheel is engagable to said thumb post in between said eyelet guide and said stop block to secure the relative position of said thumb post.

9. The adjustable depth of drive device of claim 8, wherein said platform has at least one upper plate and one lower plate, and said platform has at least one curved shoulder that connects said at least one upper plate to said lower plate in a parallel relationship.

10. The adjustable depth of drive device of claim 9, further comprising a locating lug attached to said at least one upper plate and disposed to engage said locating slot of said spring member.

11. The adjustable depth of drive device of claim 9, wherein said lower plate defines at least one platform securing hole, and a fastener uses at least one platform securing hole to attach said wire form to said spring member and said stop block.

12. An adjustable depth of drive device for use on a fastener-driving tool having a housing structure which defines an axis and encloses a combustion chamber, and a nosepiece which extends axially from the housing structure along with a work piece contact element, comprising:

a thumb post which is mounted to, and extends from the work piece contact element;

a thumb wheel adjustably engaged on said thumb post; and a spring member in a relationship with said thumb wheel in at least two positions, in a first position, said spring member is frictionally engaged with said thumb wheel to prevent unwanted movement of said thumb wheel relative to said thumb post, and in a second position, said spring member is disengaged from said thumb wheel to permit free rotation of said thumb wheel on said thumb post, said spring member has a thumb lever for moving said spring member into said second position, allowing for gross adjustments of the position of the work piece contacting element relative to the nosepiece, and wherein said spring member has a plate and a securing tab, which are in a parallel displaced relationship with one another, and said plate defines a locating slot.

13. The adjustable depth of drive device of claim 12, wherein said spring member has at least one flange, and said at least one flange connects said plate to said thumb lever and said securing tab.

14. An adjustable depth of drive device for use on a fastener driving tool having a housing structure which defines an axis and encloses a combustion chamber, and a nosepiece which extends axially from the housing structure along with a work piece contact element, comprising:

a thumb post which is mounted to, and extends from the work piece contact element;

a thumb wheel adjustably engaged on said thumb post; and a spring member in operational relationship with said thumb wheel in at least two positions, in a first position, said spring member is directly accessible and frictionally biased against said thumb wheel to prevent unwanted movement yet permitting manual, bias-overcoming, rotatable fine adjustment of said thumb wheel relative to said thumb post, and in a second position, said spring member is disengaged from said thumb wheel to permit free rotation of said thumb wheel on said thumb post, wherein said spring member has a thumb lever for moving said spring member into said second position, allowing for gross adjustments of the position of the work piece contacting element relative to the nosepiece, and wherein said spring member has a plate and a securing tab in a parallel displaced relationship with one another, and said plate defines a locating slot.

15. An adjustable depth of drive device for use on a fastener driving tool having a housing structure which defines an axis and encloses a combustion chamber, and a nosepiece which extends axially from the housing structure along with a work piece contact element, comprising:

a thumb post which is mounted to, and extends from the work piece contact element;

a thumb wheel adjustably engaged on said thumb post; and a spring member in operational relationship with said thumb wheel in at least two positions, in a first position, said spring member is directly accessible and in frictionally biased engagement against said thumb wheel, said spring member in said frictionally biased engagement being configured for preventing unwanted movement of said thumb wheel yet being configured for permitting manual, bias-overcoming, rotatable fine adjustment of said thumb wheel relative to said thumb post, and in a second position, said spring member being directly accessible and disengagable from said thumb wheel to permit free rotation of said thumb wheel on said thumb post;

wherein said adjustable depth of drive device is located on one of said work piece contact element and said nosepiece.

* * * * *